US008973537B2

(12) United States Patent
Lee et al.

(10) Patent No.: US 8,973,537 B2
(45) Date of Patent: Mar. 10, 2015

(54) ENGINE HAVING THERMOSTAT AND SYSTEM THEREOF

(71) Applicants: Hyundai Motor Company, Seoul (KR); Kia Motors Corporation, Seoul (KR)

(72) Inventors: Philgi Lee, Suwon-si (KR); Gyuhwan Kim, Suwon-si (KR); Jae Suk Park, Suwon-si (KR); Yong Jeong Kim, Ansan-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 13/974,608

(22) Filed: Aug. 23, 2013

(65) Prior Publication Data

US 2014/0182522 A1 Jul. 3, 2014

(30) Foreign Application Priority Data

Dec. 27, 2012 (KR) ..... 10-2012-0155365

(51) Int. Cl.
*F01P 7/00* (2006.01)
*F01P 7/16* (2006.01)

(52) U.S. Cl.
CPC ..... *F01P 7/16* (2013.01)
USPC ..... 123/41.58; 123/41.29; 236/34.5

(58) Field of Classification Search
CPC ..... F01P 7/16; F01P 2025/13; F01P 2025/40; F01P 2025/42; F01P 2025/44; F01P 7/167; G05D 23/022; G05D 23/1333; G05D 23/021; G05D 23/134
USPC ..... 123/41.1, 41.01, 41.58; 236/34.5, 51, 236/101 R
See application file for complete search history.

(56) References Cited

U.S. PATENT DOCUMENTS

| | | | | |
|---|---|---|---|---|
| 4,674,679 | A * | 6/1987 | Saur | 236/34.5 |
| 4,883,225 | A | 11/1989 | Kitchens | |
| 4,991,546 | A * | 2/1991 | Yoshimura | 123/41.31 |
| 5,868,105 | A * | 2/1999 | Evans | 123/41.5 |
| 6,386,150 | B1 * | 5/2002 | Iwaki | 123/41.1 |
| 6,761,321 | B2 | 7/2004 | Takahashi | |
| 6,764,020 | B1 * | 7/2004 | Zhao et al. | 236/68 R |
| 6,820,817 | B2 | 11/2004 | Leu | |

(Continued)

FOREIGN PATENT DOCUMENTS

| | | | |
|---|---|---|---|
| JP | 2003-120295 | A | 4/2003 |
| JP | 2003-239744 | A | 8/2003 |

(Continued)

*Primary Examiner* — Noah Kamen
*Assistant Examiner* — Long T Tran
(74) *Attorney, Agent, or Firm* — Morgan, Lewis & Bockius LLP

(57) ABSTRACT

An engine system may include a thermostat casing connected to a first, second, third, and fourth flow channels, a valve guide in which a main valve that opens and closes the first flow channel is formed at one side, a closing valve that opens and closes the second flow channel is formed at the other side, and a bypass valve is formed adjacent to the closing valve, an elastic member that elastically supports the valve guide to enable the main valve to block the first flow channel and the closing valve to block the second flow channel, a driver that moves the valve guide so that the main valve opens the first flow channel and the closing valve opens the second flow channel according to a temperature of a coolant, and a control unit that controls the temperature and a flow of the coolant by controlling the driver.

13 Claims, 4 Drawing Sheets

(56) References Cited

U.S. PATENT DOCUMENTS

| | | | | |
|---|---|---|---|---|
| 6,857,576 | B2 | 2/2005 | Peter | |
| 7,172,135 | B2 | 2/2007 | Masuko et al. | |
| 7,249,575 | B2 * | 7/2007 | Pottie et al. | 123/41.1 |
| 7,483,105 | B2 | 1/2009 | Jun et al. | |
| 8,201,525 | B2 * | 6/2012 | Shiobara et al. | 123/41.1 |
| 8,434,432 | B2 * | 5/2013 | Magro | 123/41.1 |
| 2004/0178281 | A1 * | 9/2004 | Moriyama et al. | 236/93 R |
| 2006/0130778 | A1 * | 6/2006 | Pottie et al. | 123/41.1 |
| 2008/0115747 | A1 * | 5/2008 | Snyder et al. | 123/41.31 |
| 2013/0213600 | A1 * | 8/2013 | Saitoh | 165/11.1 |

FOREIGN PATENT DOCUMENTS

| | | | |
|---|---|---|---|
| JP | 2003-239745 | A | 8/2003 |
| JP | 2004-100479 | A | 4/2004 |
| JP | 2005-98153 | A | 4/2005 |
| KR | 2003-0016953 | A | 3/2003 |
| KR | 2003-0077945 | A | 10/2003 |

* cited by examiner

ENGINE HAVING THERMOSTAT AND SYSTEM THEREOF

CROSS-REFERENCE TO RELATED APPLICATION

The present application claims priority of Korean Patent Application Number 10-2012-0155365 filed Dec. 27, 2012, the entire contents of which application are incorporated herein for all purposes by this reference.

BACKGROUND OF INVENTION

1. Field of Invention

The present invention relates to an engine having a thermostat and a system thereof that actively control a temperature of a coolant by converting a flow channel of the coolant according to a temperature of the coolant that is circulated to prevent overheating.

2. Description of Related Art

A vehicle thermostat is installed between an engine and a radiator and maintains a coolant in a predetermined temperature range by adjusting a flux flowing to a radiator while being automatically opened and closed according to a temperature change of a coolant.

In a mechanical thermostat, a wax expands according to a temperature of a coolant, and a piston causes an opening and closing displacement of a valve by such an expansion force.

Such a mechanical thermostat operates according to an opening and closing temperature that is set to a predetermined temperature, simply opens and closes only in a predetermined temperature, and does not actively cope with a change such as driving circumstances or a situation of a vehicle.

An electronic thermostat for maintaining a coolant temperature of an engine to an optimal state while supplementing a drawback of a mechanical thermostat is suggested.

Such an electronic thermostat can maintain an optimal coolant temperature by actively controlling a coolant temperature of an engine according to a driving environment such as a load state of a vehicle and can obtain a fuel consumption improvement effect and an exhaust gas reduction effect, compared with a mechanical thermostat.

In order to open and close a valve of the thermostat, a temperature sensitive type and electronically actively controlled driver is applied, and such a driver includes a wax, a half fluid, a rubber piston, a backup plate, and a main piston.

Here, the wax, the half fluid, the rubber piston, the backup plate, and the main piston are sequentially disposed in a length direction to form a sealing structure, and the main piston moves in the front-rear direction according to expansion of the wax.

In a cold state, the coolant does not circulate a radiator and is heated by circulating a bypass of the thermostat and the engine.

However, in order to reduce fuel consumption and to improve a quality of an exhaust gas, a research of more quickly hitting a coolant has been continued.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide an engine having a thermostat and a system thereof having advantages of reducing fuel consumption and improving a quality of an exhaust gas by more quickly heating a temperature of a coolant that circulates an engine and a thermostat.

Various aspects of the present invention provide an engine system having a thermostat, the system including: a thermostat casing that has one side connected to a first flow channel, the other side connected to a second flow channel, and a wall between the one side and the other side connected to third and fourth flow channels, a valve guide in which a main valve that opens and closes the first flow channel is formed at one side, a closing valve that opens and closes the second flow channel is formed at the other side, and a bypass valve is formed adjacent to the closing valve, an elastic member that elastically supports the valve guide to enable the main valve to block the first flow channel and the closing valve to block the second flow channel, a driver that moves the valve guide so that the main valve opens the first flow channel and the closing valve opens the second flow channel according to a temperature of a coolant, and a control unit that controls the temperature and a flow of the coolant by controlling the driver.

The control unit may control the closing valve to block the second flow channel when the main valve blocks the first flow channel.

The first flow channel may be a radiator exhaust flow channel that is connected to a radiator, the second flow channel may be an engine exhaust flow channel that is connected to one side of an engine, the third flow channel may be an engine inflow flow channel that is connected to the other side of the engine, and the fourth flow channel may be a heater exhaust flow channel that is connected to a heater.

The driver may include a wax that is filled in a wax case and contracts or expands according to a temperature, and a main piston that moves the valve guide in a front-rear direction by expansion of the wax.

When the main valve blocks the first flow channel and the closing valve blocks the second flow channel, the control unit may control the coolant so that the coolant circulates the engine, the heater and the thermostat through the heater exhaust flow channel and the engine inflow flow channel.

The control unit may control the heater to heat the coolant, if the temperature of the coolant is lower than a predetermined value.

The bypass valve may be formed at a predetermined distance toward the main valve from the closing valve, and when the driver does not move the valve guide, the control unit may control the main valve to close the first flow channel and the closing valve to close the second flow channel, and when the driver moves the valve guide in a predetermined intermediate operation state, the control unit may control the main valve to open the first flow channel and the closing valve to open the second flow channel, and when the driver moves the valve guide in a predetermined maximum operation state, the control unit may control the main valve to open the first flow channel to the maximum and the bypass valve to close the second flow channel.

The control unit may stop operation of the heater and block the flow of the coolant that is supplied to the heater through a heating line adjustment valve, if the temperature of the coolant is equal to or larger than a predetermined value.

The control unit may operate the heater and adjust the flow of the coolant that is supplied to the heater through a heating line adjustment valve, if the temperature of the coolant is less than a predetermined value.

Various other aspects of the present invention provide an engine having a thermostat, the engine including: a thermostat casing that has one side connected to a first flow channel, the other side connected to a second flow channel, and a wall between the one side and the other side connected to third and fourth flow channels, a valve guide in which a main valve that opens and closes the first flow channel is formed at one side, a closing valve that opens and closes the second flow channel is formed at the other side, and a bypass valve is formed adjacent to the closing valve, an elastic member that elastically supports the valve guide to enable the main valve to block the first flow channel and the closing valve to block the second flow channel, a driver that moves the valve guide so that the main valve opens the first flow channel and the closing valve opens the second flow channel according to a temperature of a coolant.

The closing valve may block the second flow channel when the main valve blocks the first flow channel.

The driver may include a wax that is filled in a wax case and contracts or expands according to a temperature, and a main piston that moves the valve guide in a front-rear direction by expansion of the wax.

When the main valve blocks the first flow channel and the closing valve blocks the second flow channel, the coolant may circulate the engine, the heater and the thermostat through the heater exhaust flow channel and the engine inflow flow channel.

The bypass valve may be formed at a predetermined distance toward the main valve from the closing valve, and when the driver does not move the valve guide, the main valve may close the first flow channel and the closing valve may close the second flow channel, and when the driver moves the valve guide in a predetermined intermediate operation state, the main valve may open the first flow channel and the closing valve may open the second flow channel, and when the driver moves the valve guide in a predetermined maximum operation state, the main valve may open the first flow channel to the maximum and the bypass valve may close the second flow channel.

In an engine system having a thermostat of the present invention, in a state in which a first flow channel that is connected to a radiator is blocked in a thermostat casing, by blocking a second flow channel that is connected an engine and by enabling a coolant to circulate an engine, a heater, and a thermostat, a temperature of the coolant can be more quickly heated. Therefore, fuel consumption can be reduced, and a quality of an exhaust gas can be further improved.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
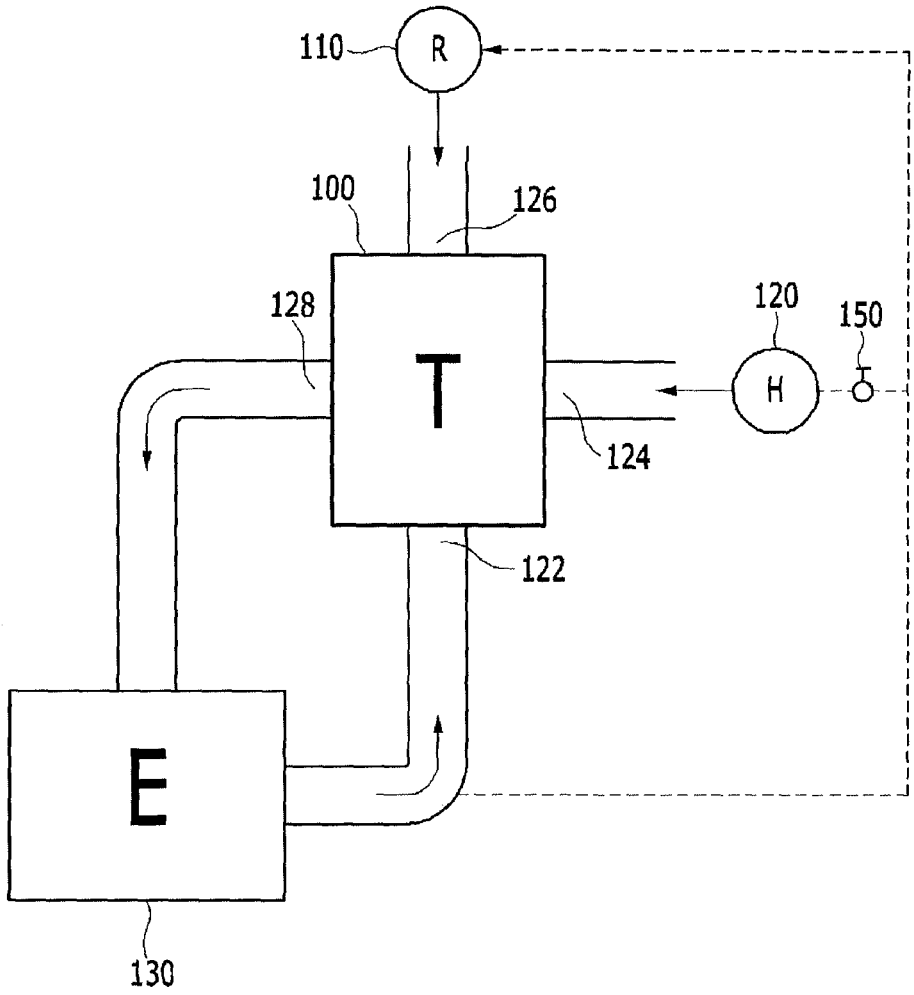
FIG. 1 is a schematic diagram of an exemplary engine system having an exemplary thermostat according to the present invention.

FIG. 1 is a schematic diagram of an engine system having a thermostat according to various embodiments of the present invention. Referring to FIG. 1, the engine system having a thermostat includes an engine 130, a thermostat 100, a heater 120, an engine exhaust flow channel 122, an engine inflow flow channel 128, a heater exhaust flow channel 124, a radiator exhaust flow channel 126, and a heating line adjustment valve 150.

Further, the thermostat 100 includes a thermostat case 140, and the thermostat case 140 is connected to the engine exhaust flow channel 122, the heater exhaust flow channel 124, the radiator exhaust flow channel 126, and the engine inflow flow channel 128.

A coolant is used for cooling the engine 130, and when a temperature of the coolant is lower than a predetermined value, the thermostat 100 enables a coolant to circulate the heater 120 and the engine 130.

When a temperature of the coolant is higher than a predetermined value, the thermostat 100 enables a coolant to circulate the engine 130 and a radiator 110.

In more detail, a cold coolant circulates through the heater 120, the heater exhaust flow channel 124, the thermostat 100, and the engine inflow flow channel 128, and a coolant is quickly heated through the heater 120.

In various embodiments of the present invention, the heating line adjustment valve 150 may be installed in the heater exhaust flow channel 124, and the heating line adjustment valve 150 selectively supplies a coolant to the heater 120.

Further, a hot coolant circulates the radiator 110, the thermostat 100 and the engine 130, and a coolant is cooled through the radiator 110.

Figure 2:
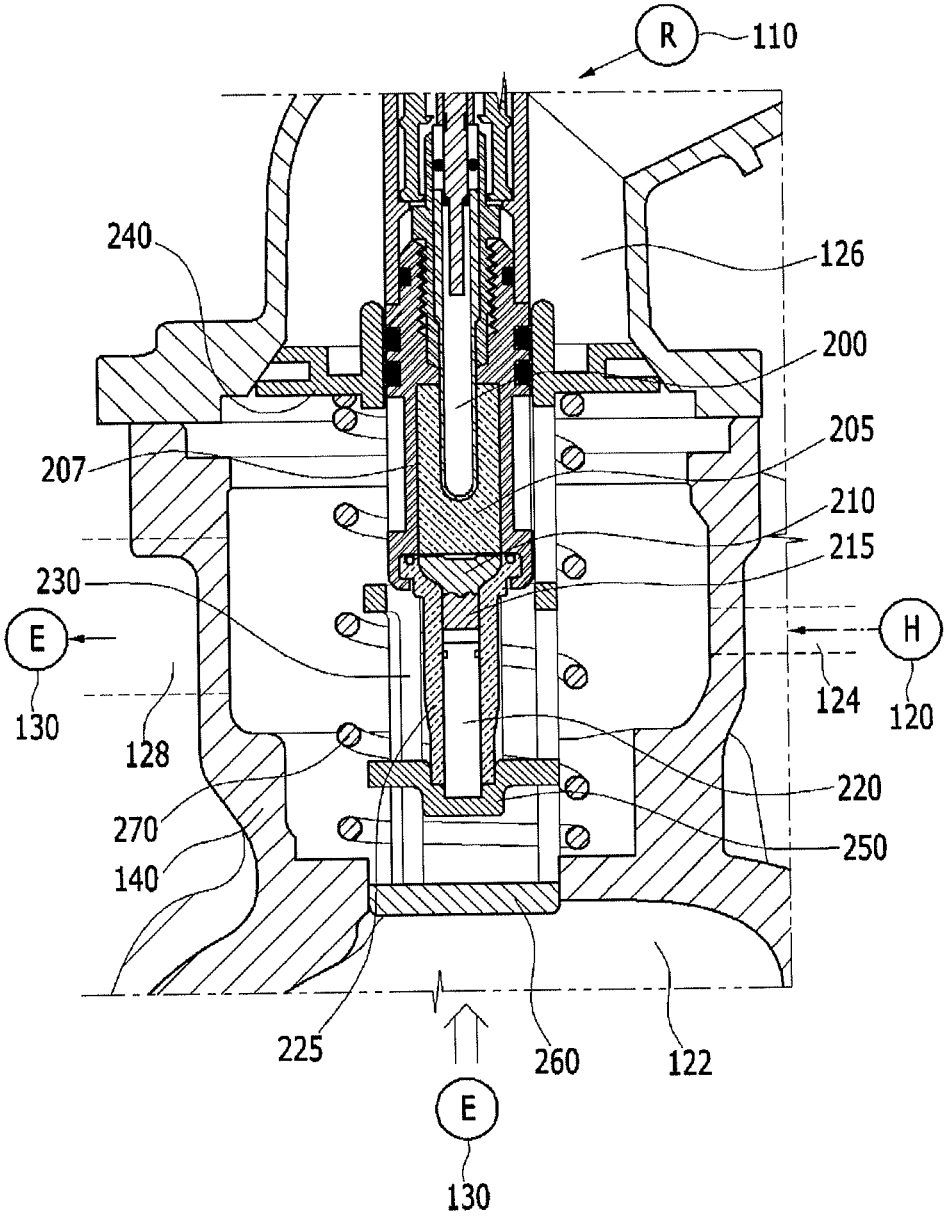
FIG. 2 is a cross-sectional view illustrating an entire structure of an exemplary thermostat according to the present invention.
Figure 3:
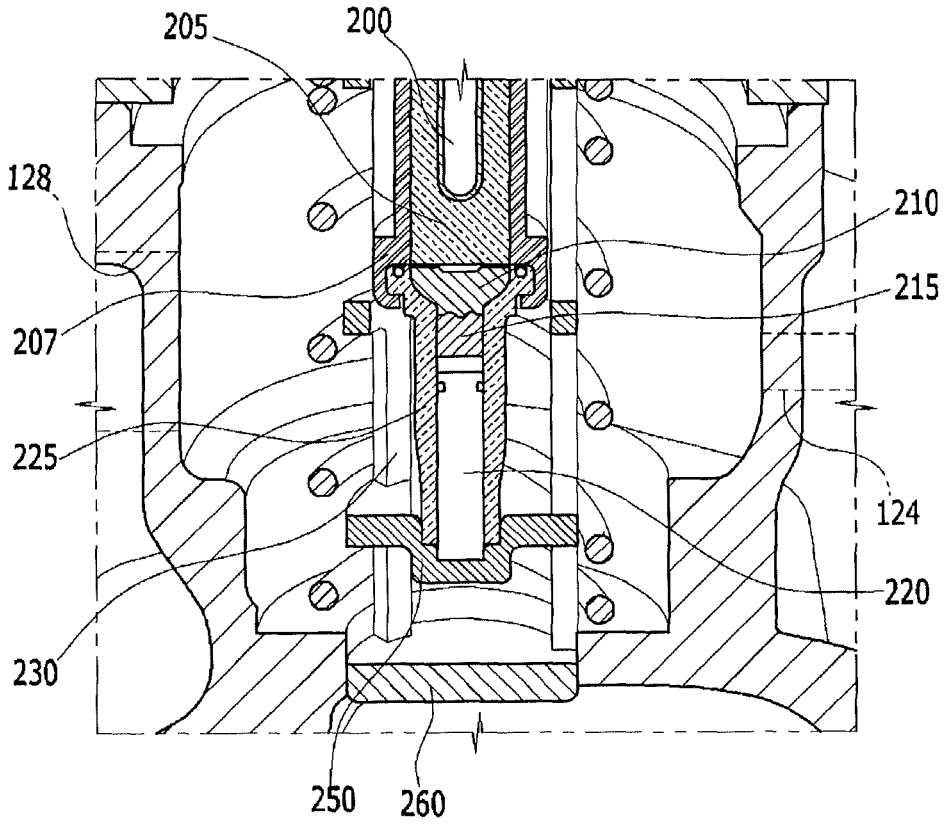
FIG. 3 is a cross-sectional view illustrating a structure of an exemplary thermostat according to the present invention.

FIG. 2 is a cross-sectional view illustrating an entire structure of a thermostat and FIG. 3 is a cross-sectional view illustrating a structure of a thermostat according to various embodiments of the present invention.

A detailed description of constituent elements identical to or similar to those described in FIG. 1 will be omitted.

Referring to FIGS. 2 and 3, the thermostat 100 includes a main valve 240, a wax case 207, a valve guide 230, an elastic member 270, a bypass valve 265, a closing valve 260, a piston support 250, a main piston 220, a rubber piston 215, a half fluid 210, a wax 205, and a glow heater 200.

In an upper end portion of the valve guide 230, the main valve 240 is formed, and the main valve 240 blocks the radiator exhaust flow channel 126. Further, in a lower end portion of the valve guide 230, the closing valve 260 is formed, and the closing valve 260 blocks the engine exhaust flow channel 122.

At one side of the main valve 240, the bypass valve 265 is formed adjacent to the closing valve 260. A distance between the closing valve 260 and the bypass valve 265 may be changed according to a design specification.

The elastic member 270 elastically supports the valve guide 230 upward to enable the main valve 240 to block the radiator exhaust flow channel 126 and enable the closing valve 260 to block the engine exhaust flow channel 122.

Further, a driver that moves the valve guide 230 is formed with at least one of the wax case 207, the glow heater 200, the wax 205, the half fluid 210, the rubber piston 215, the main piston 220, and a piston guide 225.

When a temperature of the wax 205 rises according to a temperature of the glow heater 200 or a peripheral coolant, the wax 205 expands to move the main piston 220 downward through the half fluid 210 and the rubber piston 215.

When the main piston 220 moves downward, the main piston 220 presses downward the piston support 250 that is integrally formed with the valve guide 230, and the valve guide 230 moves downward.

Figure 4:
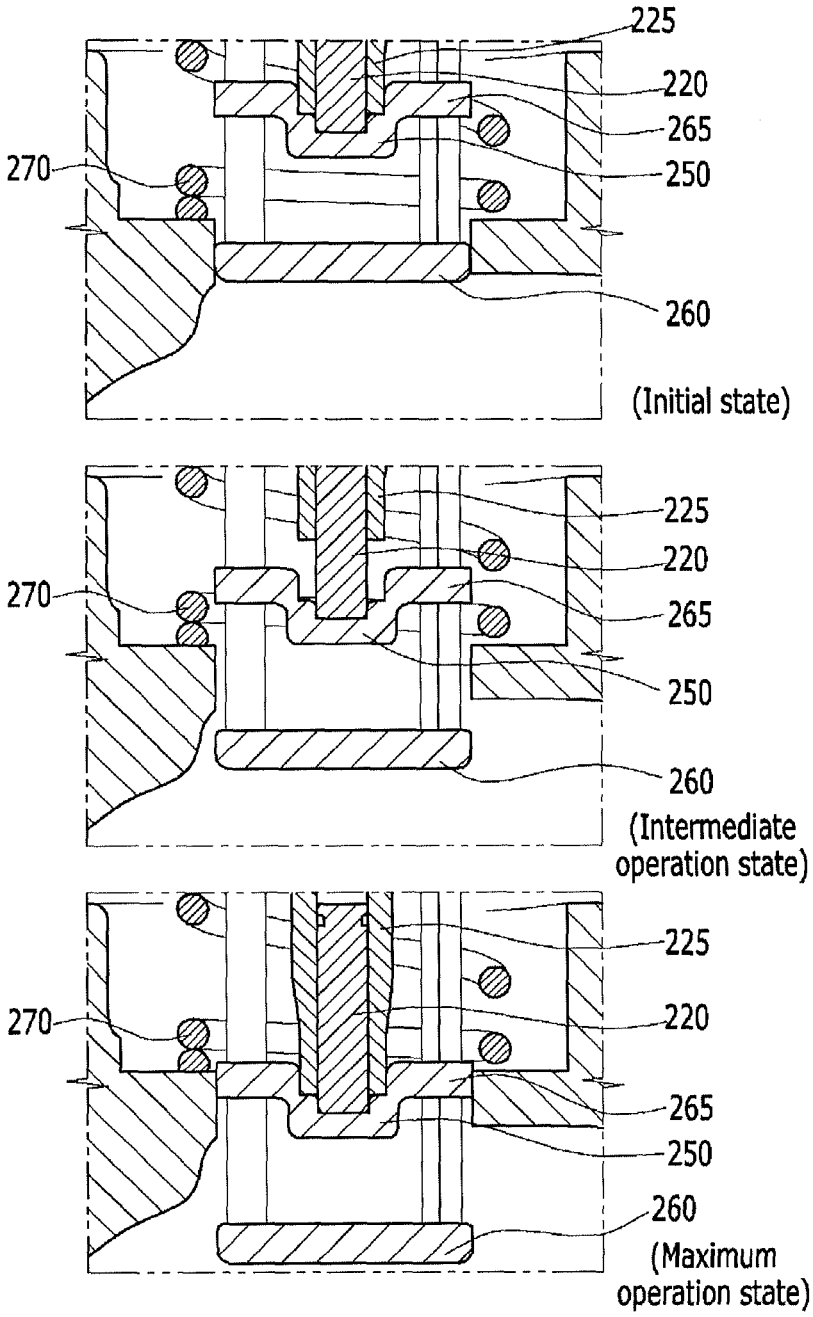
FIG. 4 is a cross-sectional view illustrating three operation states of an exemplary thermostat according to the present invention.

FIG. 4 is a cross-sectional view illustrating three operation states of a thermostat according to various embodiments of the present invention. In an initial operation state (e.g., lift=0 mm) in which the driver does not operate, the radiator exhaust flow channel 126 and the engine exhaust flow channel 122 are blocked by the main valve 240 and the closing valve 260.

Here, a coolant circulates the engine 130, the heater 120, and the thermostat 100. That is, a coolant circulates the engine 130, the heater 120, the heater exhaust flow channel 124, and the engine inflow flow channel 128. The heating line adjustment valve 150 is opened to operate the heater 120 according to a temperature of the coolant.

In an intermediate operation state (e.g., lift=5 mm) in which the driver operates in an intermediate level (e.g., 50%), the main valve 240 opens the radiator exhaust flow channel 126 by about 50%, and the closing valve 260 and the bypass valve 265 open the engine exhaust flow channel 122 by about 50%.

Here, a portion of the coolant circulates the engine 130, the radiator 110, the radiator exhaust flow channel 126, the thermostat 100, and the engine inflow flow channel 128, and the remaining coolant circulates the engine 130, the engine exhaust flow channel 122, the engine inflow flow channel 128, and the thermostat 100. The heating line adjustment valve 150 is closed, and the heater 120 does not operate.

In a maximum operation state (e.g., lift=10 mm) in which the driver operates to the maximum (100%), the main valve 240 opens the radiator exhaust flow channel 126 by 100%, and the bypass valve 265 closes the engine exhaust flow channel 122.

Here, the coolant circulates the engine 130, the radiator 110, the radiator exhaust flow channel 126, the thermostat 100, and the engine inflow flow channel 128. Further, the heating line adjustment valve 150 is closed, and the heater 120 does not operate.

In various embodiments of the present invention, the radiator exhaust flow channel 126 is referred to as a first flow channel, the engine exhaust flow channel 122 is referred to as a second flow channel, the engine inflow flow channel 128 is referred to as a third flow channel, and the heater exhaust flow channel 124 is referred to as a fourth flow channel.

The thermostat 100 of the present invention may be applied to a coolant outlet that is disposed at a coolant outlet of the engine, and the thermostat 100 may be applied to a coolant inlet that is disposed at a coolant inlet of the engine.

For convenience in explanation and accurate definition in the appended claims, the terms "upper" or "lower", "front" or "rear", "upward" or "downward", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine system having a thermostat, the engine system comprising:

a thermostat casing that has one side connected to a first flow channel, the other side connected to a second flow channel, and a wall between the one side and the other side connected to third and fourth flow channels;

a valve guide in which a main valve that opens and closes the first flow channel is formed at one side, a closing valve that opens and closes the second flow channel is formed at the other side, and a bypass valve is formed adjacent to the closing valve;

an elastic member that elastically supports the valve guide to enable the main valve to block the first flow channel and the closing valve to block the second flow channel;

a driver that moves the valve guide so that the main valve opens the first flow channel and the closing valve opens the second flow channel according to a temperature of a coolant; and a control unit that controls the temperature and a flow of the coolant by controlling the driver, wherein the first flow channel is a radiator exhaust flow channel that is connected to a radiator, the second flow channel is an engine exhaust flow channel that is connected to one side of an engine, the third flow channel is an engine inflow flow channel that is connected to the other side of the engine, and the fourth flow channel is a heater exhaust flow channel that is connected to a heater.

2. The engine system of claim 1, wherein the closing valve blocks the second flow channel when the main valve blocks the first flow channel.

3. The engine system of claim 1, wherein the driver comprises:

a wax that is filled in a wax case and contracts or expands according to a temperature; and a main piston that moves the valve guide in a front-rear direction by expansion of the wax.

4. The engine system of claim 1, wherein when the main valve blocks the first flow channel and the closing valve blocks the second flow channel, the control unit controls the coolant so that the coolant circulates the engine, the heater and the thermostat through the heater exhaust flow channel and the engine inflow flow channel.

5. The engine system of claim 4, wherein the control unit controls the heater to heat the coolant, if the temperature of the coolant is lower than a predetermined value.

6. The engine system of claim 1, wherein the bypass valve is formed at a predetermined distance toward the main valve from the closing valve, and when the driver does not move the valve guide, the control unit controls the main valve to close the first flow channel and the closing valve to close the second flow channel, and when the driver moves the valve guide in a predetermined intermediate operation state, the control unit controls the main valve to open the first flow channel and the closing valve to open the second flow channel, and when the driver moves the valve guide in a predetermined maximum operation state, the control unit controls the main valve to open the first flow channel to a maximum and the bypass valve to close the second flow channel.

7. The engine system of claim 1, wherein the control unit stops operation of the heater and blocks a flow of the coolant that is supplied to the heater through a heating line adjustment valve, if the temperature of the coolant is equal to or larger than a predetermined value.

8. The engine system of claim 1, wherein the control unit operates the heater and adjusts the flow of the coolant that is supplied to the heater through a heating line adjustment valve, if the temperature of the coolant is less than a predetermined value.

9. An engine having a thermostat, the engine comprising:

a thermostat casing that has one side connected to a first flow channel, the other side connected to a second flow channel, and a wall between the one side and the other side connected to third and fourth flow channels;

a valve guide in which a main valve that opens and closes the first flow channel is formed at one side, a closing valve that opens and closes the second flow channel is formed at the other side, and a bypass valve is formed adjacent to the closing valve;

an elastic member that elastically supports the valve guide to enable the main valve to block the first flow channel and the closing valve to block the second flow channel; and a driver that moves the valve guide so that the main valve opens the first flow channel and the closing valve opens the second flow channel according to a temperature of a coolant, wherein the first flow channel is a radiator exhaust flow channel that is connected to a radiator, the second flow channel is an engine exhaust flow channel that is connected to one side of an engine, the third flow channel is an engine inflow flow channel that is connected to the other side of the engine, and the fourth flow channel is a heater exhaust flow channel that is connected to a heater.

10. The engine of claim 9, wherein the closing valve blocks the second flow channel when the main valve blocks the first flow channel.

11. The engine of claim 9, wherein the driver comprises:

a wax that is filled in a wax case and contracts or expands according to a temperature; and a main piston that moves the valve guide in a front-rear direction by expansion of the wax.

12. The engine of claim 9, wherein when the main valve blocks the first flow channel and the closing valve blocks the second flow channel, the coolant circulates the engine, the heater and the thermostat through the heater exhaust flow channel and the engine inflow flow channel.

13. The engine of claim 9, wherein the bypass valve is formed at a predetermined distance toward the main valve from the closing valve, and when the driver does not move the valve guide, the main valve closes the first flow channel and the closing valve closes the second flow channel, and when the driver moves the valve guide in a predetermined intermediate operation state, the main valve opens the first flow channel and the closing valve opens the second flow channel, and when the driver moves the valve guide in a predetermined maximum operation state, the main valve opens the first flow channel to a maximum and the bypass valve closes the second flow channel.

* * * * *